US011581650B2

(12) United States Patent
Wu et al.

(10) Patent No.: US 11,581,650 B2
(45) Date of Patent: Feb. 14, 2023

(54) MULTI-INPUT MULTI-OUTPUT ANTENNA STRUCTURE

(71) Applicant: PEGATRON CORPORATION, Taipei (TW)

(72) Inventors: Chien-Yi Wu, Taipei (TW); Chao-Hsu Wu, Taipei (TW); Cheng-Hsiung Wu, Taipei (TW); Shih-Keng Huang, Taipei (TW); Ching-Hsiang Ko, Taipei (TW); Sheng-Chin Hsu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 187 days.

(21) Appl. No.: 17/231,439

(22) Filed: Apr. 15, 2021

(65) Prior Publication Data

US 2021/0234276 A1 Jul. 29, 2021

Related U.S. Application Data

(62) Division of application No. 16/421,235, filed on May 23, 2019, now Pat. No. 11,024,969.

(30) Foreign Application Priority Data

Jul. 16, 2018 (TW) ..... 107124435

(51) Int. Cl.
*H01Q 9/16* (2006.01)
*H01Q 9/04* (2006.01)
*H01Q 9/06* (2006.01)

(52) U.S. Cl.
CPC ..... *H01Q 9/0407* (2013.01); *H01Q 9/06* (2013.01); *H01Q 9/16* (2013.01)

(58) Field of Classification Search
None
See application file for complete search history.

(56) References Cited

U.S. PATENT DOCUMENTS 9,563,838 B2 * 2/2017 Ban ..... G06K 19/07786
2008/0258991 A1 * 10/2008 Montgomery ..... H01Q 9/145 343/844
2012/0038519 A1 * 2/2012 Su ..... H01Q 1/38 343/702
2015/0120189 A1 * 4/2015 Giometti ..... H04W 72/0453 342/450
2015/0295311 A1 * 10/2015 Bringuier ..... H01Q 1/521 343/729
2016/0156110 A1 * 6/2016 Cohen ..... H01Q 21/24 343/810

* cited by examiner

*Primary Examiner* — Crystal L Hammond
(74) *Attorney, Agent, or Firm* — J.C. Patents

(57) ABSTRACT

Provided is an electronic device including a multi-input multi-output antenna structure configured on a substrate, and the multi-input multi-output antenna structure includes two dipole antennas and two second grounded radiators. Each dipole antenna is used for resonating a first frequency band and a second frequency band. Each dipole antenna includes a feed-in radiator and a first grounded radiator. The feed-in radiator has a feed-in end. The first grounded radiator is disposed beside the feed-in radiator and has a first grounded end. The two second grounded radiators are positioned between the two dipole antennas, the two second grounded radiators are separated from the two first grounded radiators and are respectively corresponding to the two first grounded radiators, and a bent gap is formed between the two second grounded radiators.

4 Claims, 11 Drawing Sheets

MULTI-INPUT MULTI-OUTPUT ANTENNA STRUCTURE

CROSS-REFERENCE TO RELATED APPLICATION

This Application is a Divisional Applications of and claims the priority benefit of U.S. application Ser. No. 16/421,235, filed on May 23, 2019, now allowed. The Prior application Ser. No. 16/421,235 claims priority under 35 U.S.C. § 119(a) to Patent Application No. 107124435 filed in Taiwan, R.O.C. on Jul. 16, 2018, the entire contents of which are hereby incorporated by reference.

BACKGROUND

Technical Field

The application relates to an antenna structure and in particular relates to a multi-input multi-output antenna structure.

Related Art

With the demand for miniaturization of electronic devices increasing, in order to design multiple antennas in a limited space, it is necessary to consider the isolation between these antennas and the radiation patterns of these antennas, which is definitely a challenge in the antenna design.

SUMMARY

The application provides a multi-input multi-output antenna structure. The multi-input multi-output antenna structure has a small size, good isolation, an omnidirectional radiation pattern, and good performance.

The application provides an electronic device provided with at least one above-mentioned multi-input multi-output antenna structure.

The multi-input multi-output antenna structure of the application is configured on a substrate, and the multi-input multi-output antenna structure includes two dipole antennas and two second grounded radiators. Each dipole antenna is used for resonating a first frequency band and a second frequency band. Each dipole antenna includes a feed-in radiator and a first grounded radiator. The feed-in radiator has a feed-in end. The first grounded radiator is disposed beside the feed-in radiator and has a first grounded end. The two second grounded radiators are positioned between the two dipole antennas, the two second grounded radiators are separated from the two first grounded radiators and are respectively corresponding to the two first grounded radiators, and a bent gap is formed between the two second grounded radiators.

In an embodiment of the application, the width of the bent gap ranges from 0.3 mm to 1 mm.

In an embodiment of the application, the bent gap has two turning positions forming a Z shape.

In an embodiment of the application, the multi-input multi-output antenna structure has a virtual center, and one dipole antenna and the corresponding second grounded radiator can be rotated by 180 degrees around the virtual center as an axis to be overlapped with the other dipole antenna and the other second grounded radiator.

In an embodiment of the application, the multi-input multi-output antenna structure further includes two coaxial transmission lines respectively configured on two dipole antennas. Each second grounded radiator has a second grounded end. A positive end of each coaxial transmission line is connected to the feed-in end of the corresponding dipole antenna, and a negative end of each coaxial transmission line is connected to the first grounded end of the corresponding dipole antenna and the second grounded end of the corresponding second grounded radiator.

In an embodiment of the application, the distance between the two coaxial transmission lines ranges from 8 mm to 15 mm.

In an embodiment of the application, the length of each coaxial transmission line ranges from 230 mm to 500 mm.

In an embodiment of the application, the sum of the length of each feed-in radiator and the length of the corresponding first grounded radiator is ½ wavelength of the first frequency band.

In an embodiment of the application, the length of each feed-in radiator is ¼ wavelength of the first frequency band, and the length of each first grounded radiator is ¼ wavelength of the first frequency band.

In an embodiment of the application, the sum of the lengths of the two second grounded radiators is ¼ wavelength of the first frequency band.

In an embodiment of the application, the length of each second grounded radiator is ⅛ wavelength of the first frequency band.

In an embodiment of the application, the first frequency band ranges from 2400 MHz to 2500 MHz, and the second frequency band ranges from 5150 MHz to 5875 MHz.

The electronic device of the application includes a shell, a circuit board, at least one above-mentioned multi-input multi-output antenna structure, and a shielding component. The circuit board is configured in the shell. The multi-input multi-output antenna structure is configured in the shell and is in signal connection to the circuit board. The shielding component is configured in the shell and is positioned between the multi-input multi-output antenna structure and the circuit board.

In an embodiment of the application, the distance between the at least one multi-input multi-output antenna structure and the shielding component ranges from 15 mm to 70 mm.

In an embodiment of the application, the shell is a cylinder, an ellipsoid, a cuboid, a trapezoidal column, or a rugby ball body.

Based on the above, according to the multi-input multi-output antenna structure of the application, the two second grounded radiators are configured between the two dipole antennas and are separated from the two first grounded radiators of the two dipole antennas, and furthermore, the design of the bent gap between the two second grounded radiators enables the two dipole antennas to have good isolation. In this way, the two dipole antennas can be quite close but do not interfere with each other, so that the multi-input multi-output antenna structure has a smaller size. Therefore, the multi-input multi-output antenna structure can respectively resonate the first frequency band and the second frequency band with good signals in a limited space to achieve the dual-frequency property.

In order to make the aforementioned features and advantages of the application more comprehensible, embodiments are further described in detail hereinafter with reference to accompanying drawings.

DETAILED DESCRIPTION OF THE EMBODIMENTS

Figure 1:
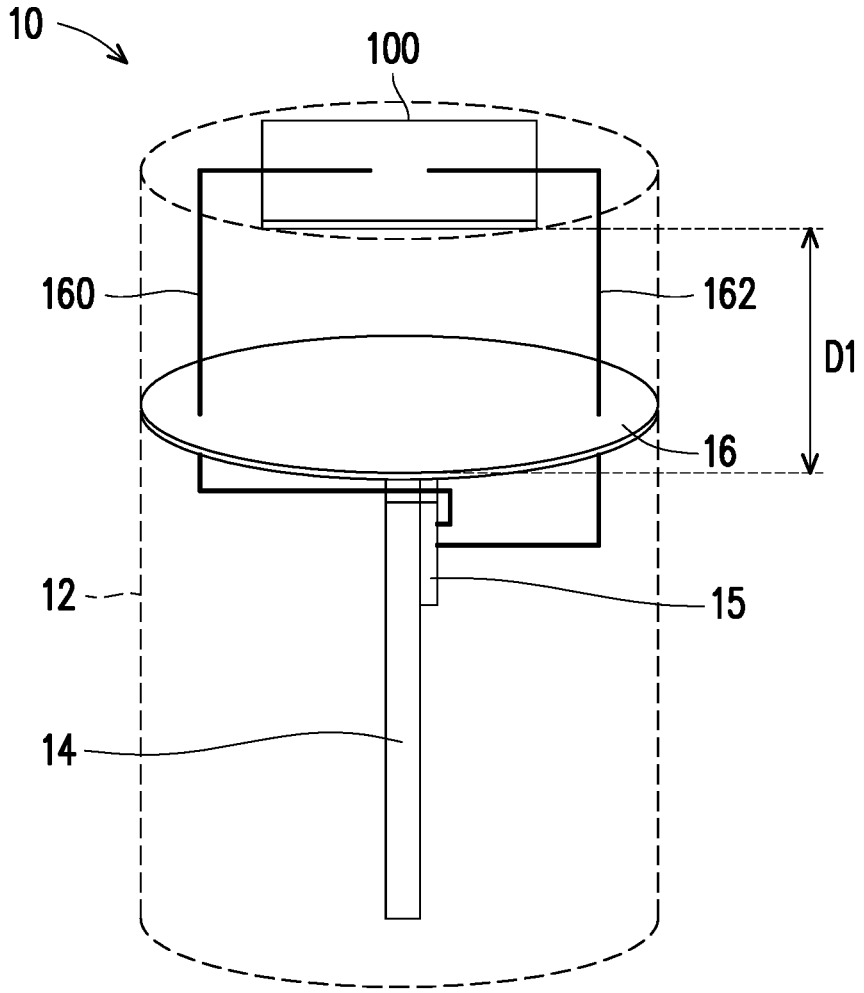
FIG. 1 is a schematic diagram of an electronic device according to an embodiment of the application.

FIG. 1 is a schematic diagram of an electronic device according to an embodiment of the application. Referring to FIG. 1, the electronic device 10 of this embodiment includes a shell 12, a circuit board 14, a multi-input multi-output antenna structure 100, and a shielding component 16. In this embodiment, the electronic device 10 is, for example, an intelligent speaker, but the type of the electronic device 10 is not limited thereto. As shown in FIG. 1, in this embodiment, the shape of the shell 12 is, for example, a cylinder.

Certainly, the shape of the shell 12 is not limited thereto. In other embodiments, the shell 12 may also be an ellipsoid, a cuboid, a trapezoidal column, or a rugby ball body. The material of the shell 12 is, for example, plastic, but the material of the shell 12 is not limited thereto, as long as the material of the part of the shell 12 near the multi-input multi-output antenna structure 100 is non-metal.

In order to clearly show the relative positions of the circuit board 14, the multi-input multi-output antenna structure 100 and the shielding component 16 in FIG. 1, the shell 12 is shown by dotted lines. As shown in FIG. 1, in this embodiment, the circuit board 14, the multi-input multi-output antenna structure 100, and the shielding component 16 are configured in the shell 12, and the circuit board 14 is separated from the multi-input multi-output antenna structure 100 by the shielding component 16. That is, the shielding component 16 is positioned between the multi-input multi-output antenna structure 100 and the circuit board 14. In this embodiment, the multi-input multi-output antenna structure 100 is positioned on the bottom surface of the top of the shell 12, but the position of the multi-input multi-output antenna structure 100 is not limited thereto.

In addition, in this embodiment, the material of the shielding component 16 is metal, and may be used for shielding the impact of an interference source on the circuit board 14 on the wireless reception quality. Certainly, the material of the shielding component 16 is not limited thereto. In addition, in this embodiment, the distance D1 between the multi-input multi-output antenna structure 100 and the shielding component 16 is at least greater than 15 mm, to reduce the impact of the shielding component 16 on the multi-input multi-output antenna structure 100. The distance D1 between the multi-input multi-output antenna structure 100 and the shielding component 16, for example, ranges from 15 mm to 70 mm but is not limited thereto.

In this embodiment, the multi-input multi-output antenna structure 100 is in signal connection to a wireless module card 15 of the circuit board 14. More specifically, the multi-input multi-output antenna structure 100 is connected to the wireless module card 15 of the circuit board 14 through two coaxial transmission lines 160 and 162, and the shielding component 16 may be provided with corresponding through holes or recesses to enable the coaxial transmission lines 160 and 162 to pass through. The length of each of the coaxial transmission lines 160 and 162, for example ranges from 230 mm to 500 mm so as to obtain a better impedance matching effect.

Figure 2:
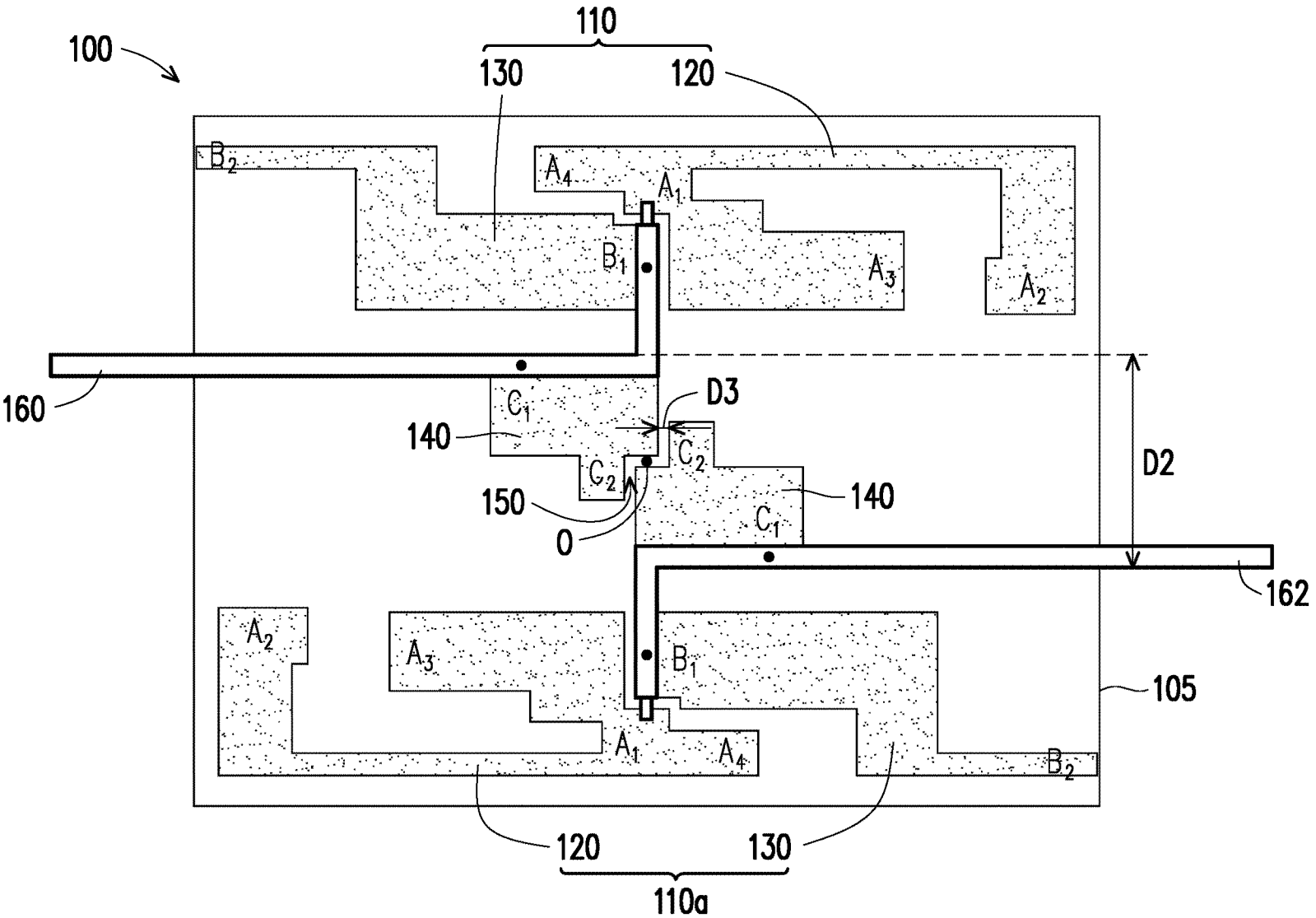
FIG. 2 is a schematic diagram of a multi-input multi-output antenna structure of the electronic device in FIG. 1.

The detailed structure of the multi-input multi-output antenna structure 100 is illustrated below. FIG. 2 is a schematic diagram of a multi-input multi-output antenna structure of the electronic device in FIG. 1. Referring to FIG. 2, the multi-input multi-output antenna structure 100 of this embodiment includes two dipole antennas 110 and 110*a*. The dipole antennas 110 and 110*a* are respectively used for resonating a first frequency band and a second frequency band. In this embodiment, the first frequency band, for example, ranges from 2400 MHz to 2500 MHz, and the second frequency band, for example, ranges from 5150 MHz to 5875 MHz. In other words, in this embodiment, the dipole antennas 110 and 110*a* are dual-frequency dipole antennas 110 and 110*a* of WiFi 2.4 GHz and WiFi 5 GHz. Certainly, the ranges of the first frequency bands and the second frequency bands of the dipole antennas 110 and 110*a* are not limited thereto.

In this embodiment, each of the dipole antennas 110 and 110*a* includes a feed-in radiator 120 and a first grounded radiator 130. The feed-in radiator 120 has a feed-in end. The first grounded radiator 130 is disposed beside the feed-in radiator 120 and has a first grounded end. More specifically, the feed-in radiator 120 is formed by a radiator extending along positions A3, A1, A4 and A2, and the feed-in end is at the position A1. The first grounded radiator 130 is formed by a radiator extending along positions B1 and B2, and the first grounded end is at the position B1. In this embodiment, the feed-in radiator 120 is separated from the first grounded radiator 130, and a gap is formed therebetween.

In this embodiment, the sum of the length of each feed-in radiator 120 and the length of the corresponding first grounded radiator 130 is ½ wavelength of the first frequency band. More specifically, the length of each feed-in radiator 120 is ¼ wavelength of the first frequency band, and the length of each first grounded radiator 130 is ¼ wavelength of the first frequency band. In addition, in this embodiment, the second frequency band (WiFi 5G) is formed by second harmonic generation of the first frequency band (WiFi 2.4G). In the multi-input multi-output antenna structure 100, the resonance bandwidth of the second frequency band (WiFi 5G) may be increased by adjusting the gap between the position A1 to the position A4 and the position B1 to the position B2. Furthermore, in this embodiment, in the multi-input multi-output antenna structure 100, the resonance frequency and the impedance matching of the first frequency band and the second frequency band may be adjusted by adjusting the path lengths and widths of the A1-A3 sections and the path lengths or widths of the A1-A4 sections.

It is worth mentioning that in this embodiment, the multi-input multi-output antenna structure 100 may be configured on a substrate 105. The substrate 105 is, for example, a flexible circuit board 14 or a hard circuit board 14, and the type of the substrate 105 is not limited thereto. In this embodiment, the length, width, and height of the substrate 105 are, for example, 40 mm, 30 mm, and 0.4 mm. The length and width of each of the dipole antennas 110 and 110*a* are, for example, 40 mm and 10 mm. When the two dipole antennas 110 and 110*a* are both configured on the substrate 105, the two dipole antennas 110 and 110*a* are quite close (for example, the distance between the two dipole antennas 110 and 110*a* is less than or equal to 10 mm). In this embodiment, the multi-input multi-output antenna structure 100 has good isolation at the first frequency band (such as WiFi 2.4 GHz) so as to reduce the probability that the two dipole antennas 110 and 110*a* are excessively close to interfere with each other.

The multi-input multi-output antenna structure 100 of this embodiment includes two second grounded radiators 140. The two second grounded radiators 140 are positioned between the two dipole antennas 110 and 110*a*, and the two second grounded radiators 140 are separated from the two first grounded radiators 130 and are respectively corresponding to the two first grounded radiators 130. In addition, in this embodiment, the second grounded radiator 140 is formed by a radiator extending along positions C1 and C2. The sum of the lengths of the two second grounded radiators 140 is ¼ wavelength of the first frequency band. More specifically, the length of each second grounded radiator 140 is ⅛ wavelength of the first frequency band. In addition, the two second grounded radiators 140 are, for example, configured on the substrate 105 in a pasted manner. Certainly, the manner of configuring the second grounded radiators 140 on the substrate 105 is not limited thereto.

It should be noted that in this embodiment, a bent gap 150 is formed between the two second grounded radiators 140. The width D3 of the bent gap 150 ranges from 0.3 mm to 1 mm, and preferably, the width D3 of the bent gap 150 is 0.5 mm. The bent gap 150 has two turning positions forming a Z shape. Certainly, the width and shape of the bent gap 150 are not limited thereto. The design of the bent gap 150 between the two second grounded radiators 140 enables the isolation (S21) of the first frequency band (such as WiFi 2.4 GHz) to be less than a specific value (such as −15 dB) so as to obtain good isolation. Furthermore, the design of the bent gap 150 between the two second grounded radiators 140 enables the envelope correlation coefficient (ECC) of the first frequency band (such as WiFi 2.4 GHz) to be less than a specific value (such as 0.1). In this way, the multi-input multi-output antenna structure 100 of this embodiment can resonate the first frequency band and the second frequency band with good signals in a limited space to achieve dual-frequency property.

In addition, as shown in FIG. 2, in this embodiment, the multi-input multi-output antenna structure 100 has a virtual center O, and the dipole antenna 110 and the corresponding second grounded radiator 140 can be rotated by 180 degrees around the virtual center O as an axis to be overlapped with the dipole antenna 110*a* and the other second grounded radiator 140. In other words, in this embodiment, the pattern of the multi-input multi-output antenna structure 100 is formed, for example, by mirroring the upper half to the lower half and then turning left and right. Certainly, the form of the multi-input multi-output antenna structure 100 is not limited thereto. In other embodiments, the relationship between the upper half and the lower half of the multi-input multi-output antenna structure 100 can also be a pattern mirrored up and down along a horizontal line passing through the virtual center 0.

In addition, the multi-input multi-output antenna structure 100 further includes two coaxial transmission lines 160 and 162, the two coaxial transmission lines 160 and 162 are respectively configured on the two dipole antennas 110 and 110*a*, each second grounded radiator 140 has a second grounded end, the second grounded end is at the position C1, positive ends of the coaxial transmission lines 160 and 162 are connected to the feed-in ends of the corresponding dipole antennas 110 and 110*a*, and negative ends of the coaxial transmission lines 160 and 162 are connected to the first grounded ends of the corresponding dipole antennas 110 and 110*a* and the second grounded ends of the corresponding second grounded radiators 140. In this embodiment, the distance D2 between the two coaxial transmission lines 160 and 162 ranges from 8 mm to 15 mm, for example, 10 mm. In addition, in this embodiment, the first grounded radiators 130 and the second grounded radiators 140 are not connected to a system ground surface (not shown) of the electronic device 10 but are grounded through the negative ends of the coaxial transmission lines 160 and 162. Certainly, the configuration of the first grounded radiators 130 and the second grounded radiators 140 is not limited thereto.

Figure 3:
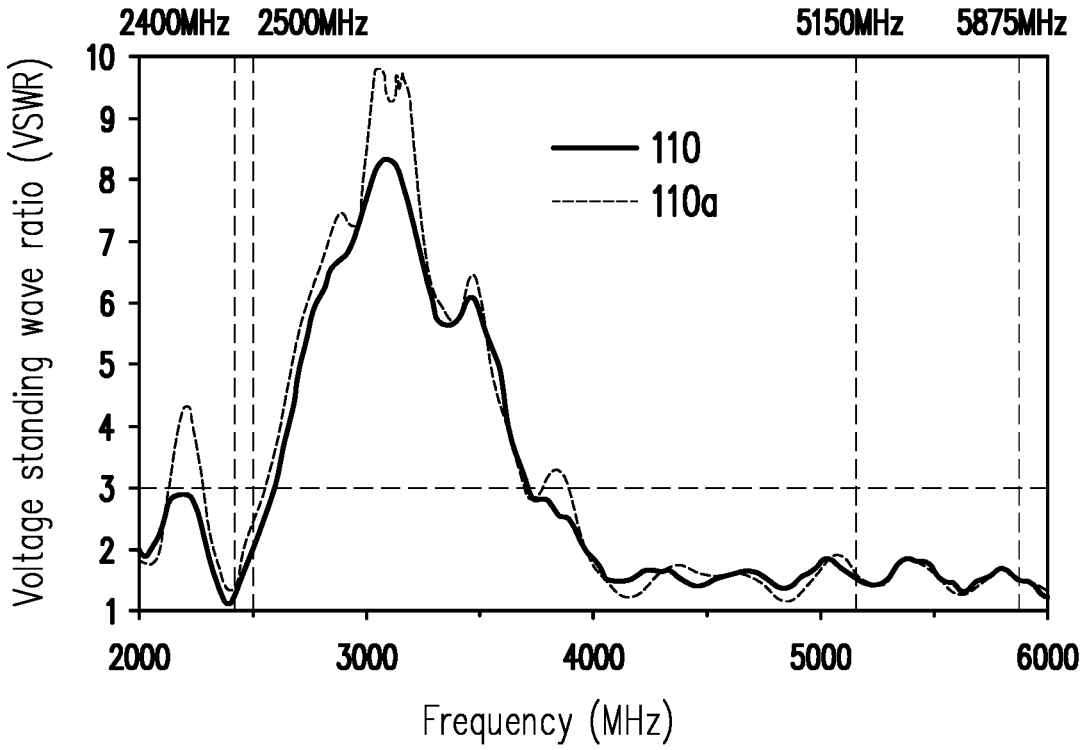
FIG. 3 is a schematic diagram of a frequency-voltage standing wave ratio of the multi-input multi-output antenna structure in FIG. 2.

FIG. 3 is a schematic diagram of a frequency-voltage standing wave ratio of the multi-input multi-output antenna structure in FIG. 2. Referring to FIG. 3, in this embodiment, the voltage standing wave ratios of the two dipole antennas 110 and 110*a* are respectively less than 3 at the first frequency band (ranging from 2400 MHz to 2500 MHz, and corresponding to WiFi 2.4G) and the second frequency band (ranging from 5150 MHz to 5875 MHz, and corresponding to WiFi 5G), so that the two dipole antennas 110 and 110*a* have good performance.

Figure 4:
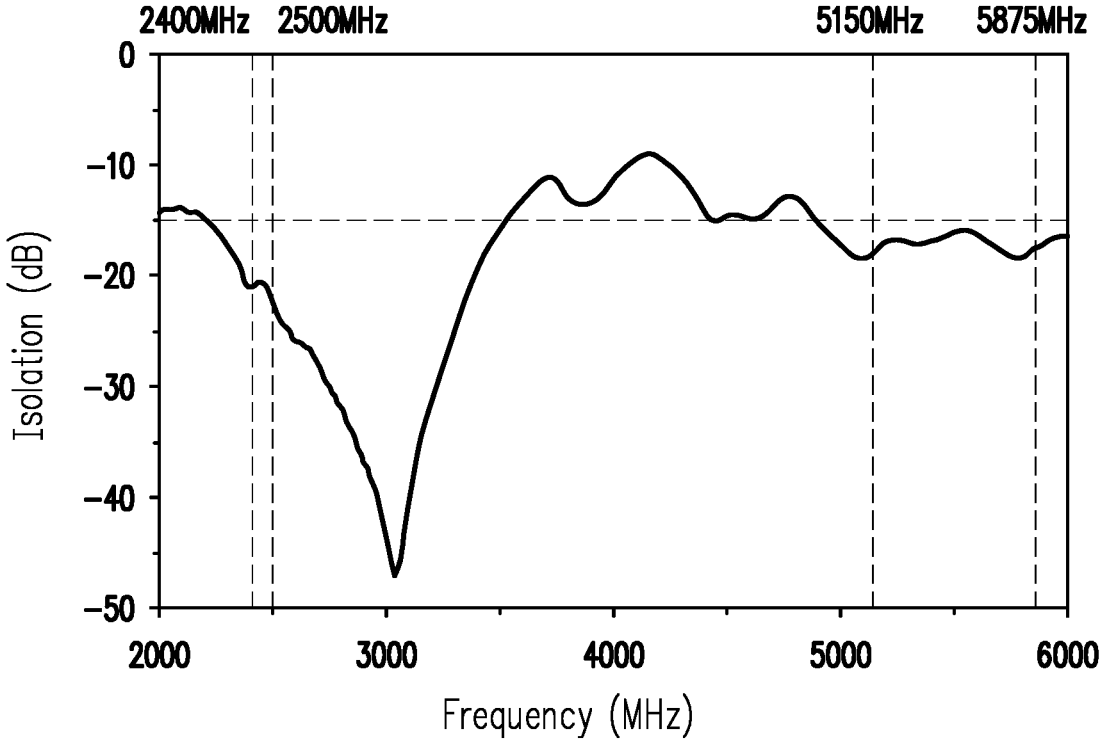
FIG. 4 is a schematic diagram of frequency-isolation of the multi-input multi-output antenna structure in FIG. 2.

FIG. 4 is a schematic diagram of frequency-isolation of the multi-input multi-output antenna structure in FIG. 2. Referring to FIG. 4, in this embodiment, the isolation of the two dipole antennas 110 and 110*a* is less than −15 dB at the first frequency band (ranging from 2400 MHz to 2500 MHz, and corresponding to WiFi 2.4G) and the second frequency band (ranging from 5150 MHz to 5875 MHz, and corresponding to WiFi 5G), or the isolation is even less than −20 dB at the first frequency band, so that the two dipole antennas 110 and 110*a* do not interfere with each other.

Figure 5:
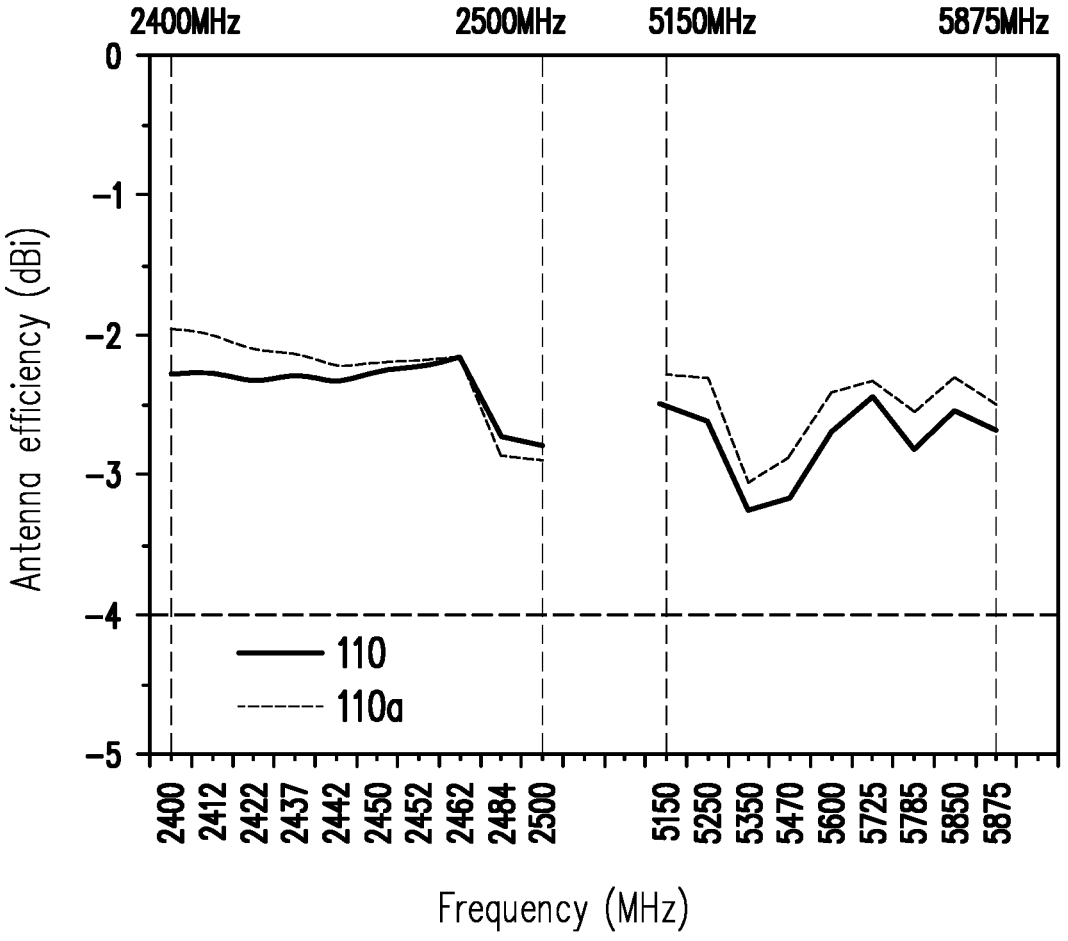
FIG. 5 is a schematic diagram of frequency-antenna efficiency of the multi-input multi-output antenna structure in FIG. 2.

FIG. 5 is a schematic diagram of frequency-antenna efficiency of the multi-input multi-output antenna structure in FIG. 2. Referring to FIG. 5, in this embodiment, the antenna efficiency of the two dipole antennas 110 and 110*a* is greater than −4 dBi at the first frequency band (for example, ranging from 2400 MHz to 2500 MHz, and corresponding to WiFi 2.4G) and the second frequency band (for example, ranging from 5150 MHz to 5875 MHz, and corresponding to WiFi 5G) respectively. More specifically, the antenna efficiency of the two dipole antennas 110 and 110*a* at the first frequency band (WiFi 2.4G) ranges from −2.0 dBi to −2.9 dBi, and the antenna efficiency of the two dipole antennas 110 and 110*a* at the second frequency band (WiFi 5G) ranges from −2.3 dBi and −3.3 dBi, so that the two dipole antennas 110 and 110*a* have good antenna efficiency.

Figure 6:
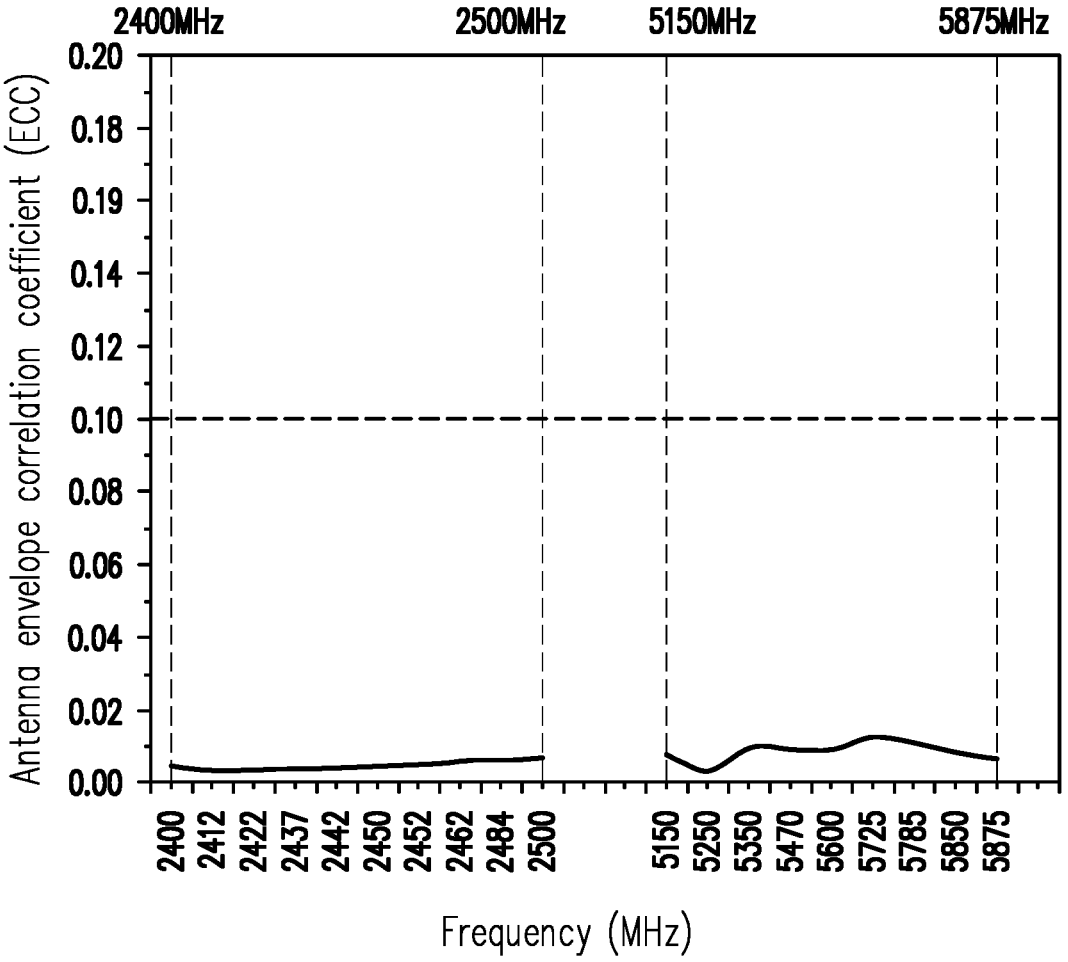
FIG. 6 is a schematic diagram of a frequency-antenna envelope correlation coefficient of the multi-input multi-output antenna structure in FIG. 2.

FIG. 6 is a schematic diagram of a frequency-antenna envelope correlation coefficient of the multi-input multi-output antenna structure in FIG. 2. Referring to FIG. 6, in this embodiment, the antenna envelope correlation coefficients (ECC) of the two dipole antennas 110 and 110*a* are less than 0.1 or even less than 0.02 at the first frequency band (ranging from 2400 MHz to 2500 MHz, and corresponding to WiFi 2.4G) and the second frequency band (ranging from 5150 MHz to 5875 MHz, and corresponding to WiFi 5G), so that the two dipole antennas 110 and 110*a* have good performance.

Figure 7:
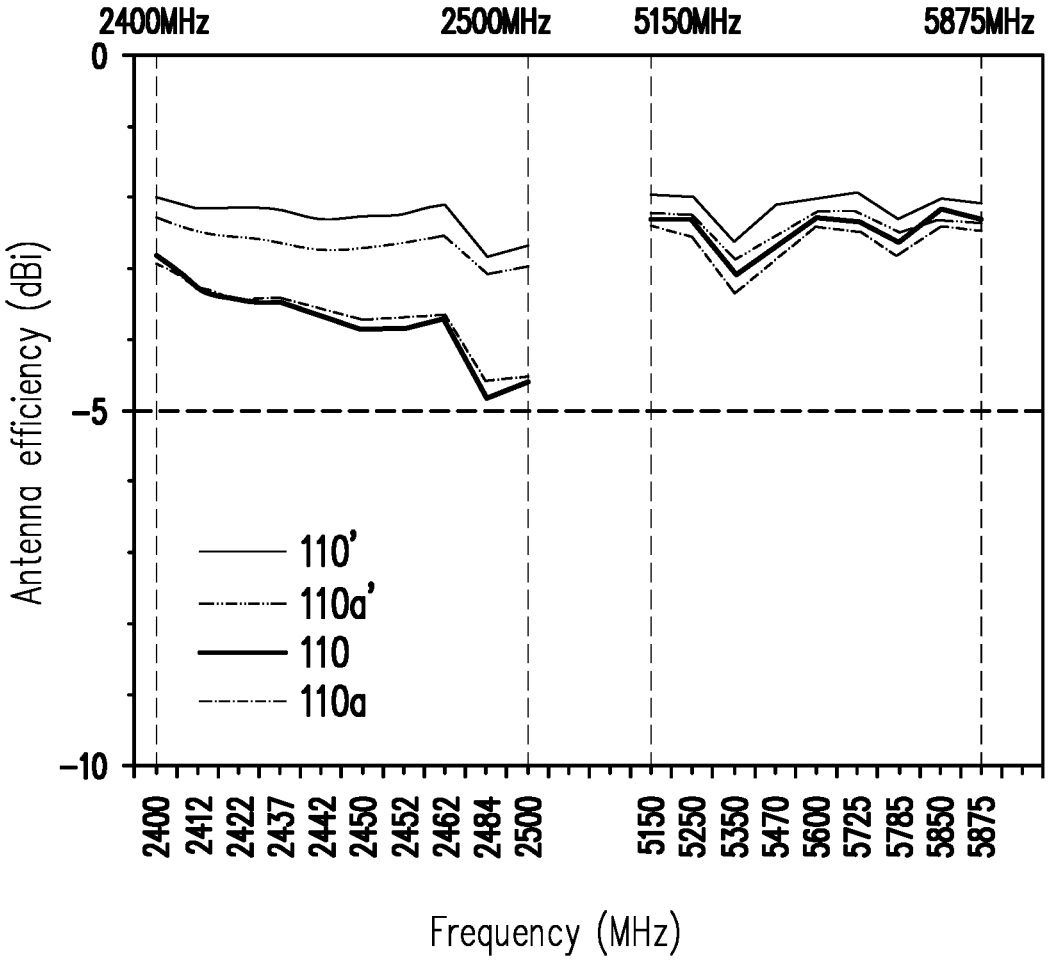
FIG. 7 is a schematic diagram of frequency-antenna efficiency when there are different distances between the multi-input multi-output antenna structure in FIG. 1 and a shielding component.

It is worth mentioning that, in the electronic device 10 in FIG. 1, the distance D1 between the multi-input multi-output antenna structure 100 and the shielding component 16 affects the antenna efficiency, especially the antenna efficiency at the first frequency band (low frequency). FIG. 7 is a schematic diagram of frequency-antenna efficiency when there are different distances between the multi-input multi-output antenna structure in FIG. 1 and the shielding component. Referring to FIG. 7, in this embodiment, the two dipole antennas 110 and 110*a* refer to antennas having a distance D1 (marked in FIG. 1) of 15 mm from the shielding component 16, and the two dipole antennas 110' and 110*a'* refer to antennas having a distance D1 of 50 mm. As can be seen in FIG. 7, the antenna efficiency of the dipole antennas 110, 110*a*, 110' and 110*a'* is greater than −5 dBi at the first frequency band (ranging from 2400 MHz to 2500 MHz, and being WiFi 2.4G) and the second frequency band (ranging from 5150 MHz to 5875 MHz, and being WiFi 5G) respectively, thereby meeting the needs. In other words, the dipole antennas 110' and 110*a'* can have good antenna efficiency as long as the distance D1 between the dipole antenna 110' or 110*a'* and the shielding component 16 is at least 15 mm. The antenna efficiency of the two dipole antennas 110' and 110*a'* may be even greater than −3 dBi at the first frequency band.

Figure 8A:
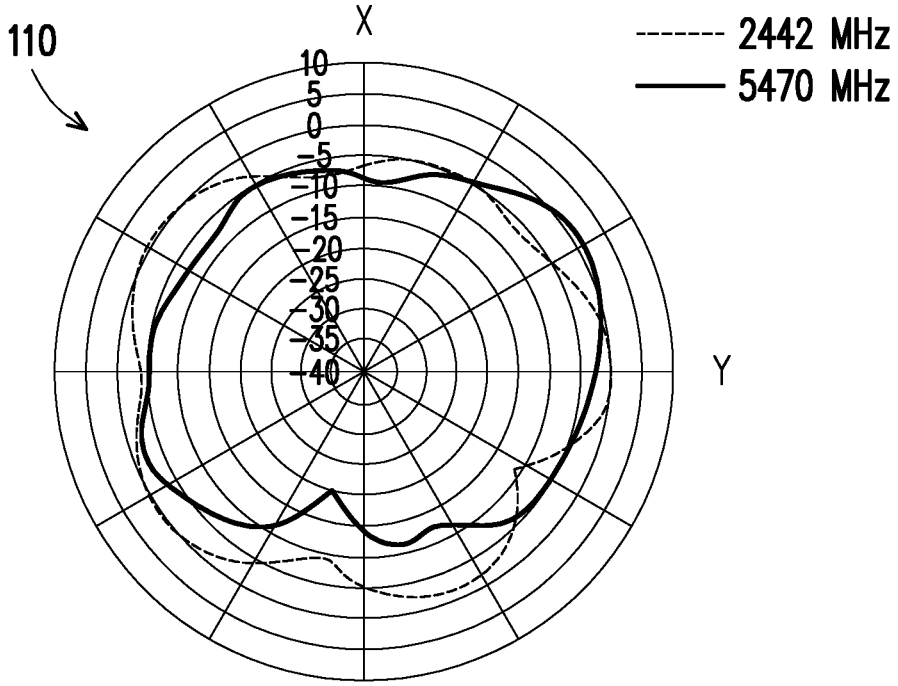
FIG. 8A, FIG. 8B, and FIG. 8C are schematic diagrams showing radiation patterns of one dipole antenna of the multi-input multi-output antenna structure in FIG. 2 in an X-Y plane, an X-Z plane, and a Y-Z plane respectively.
Figure 8B:
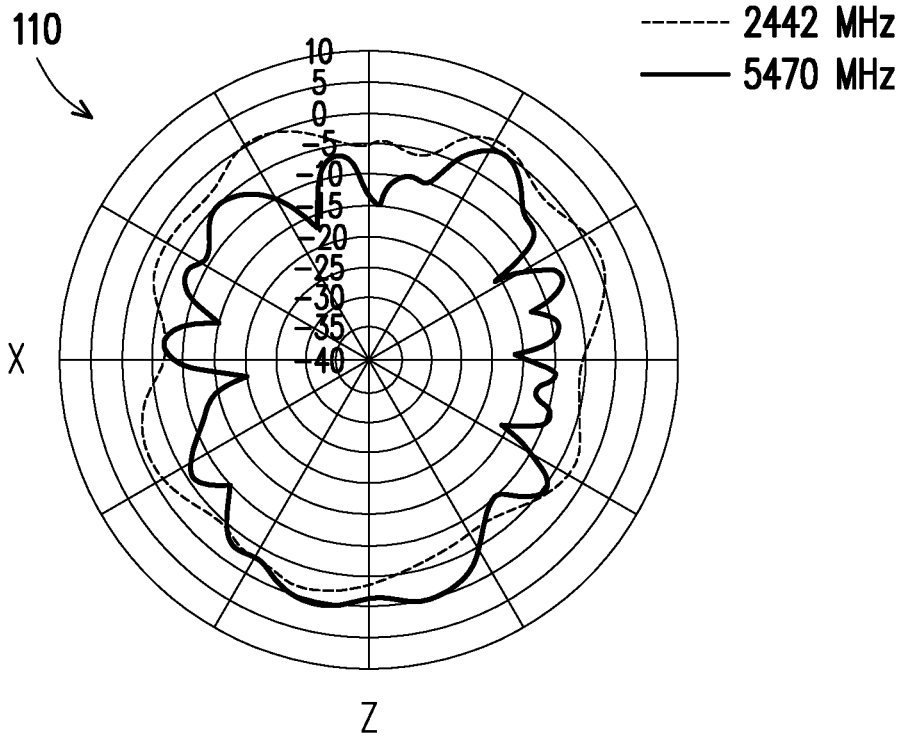
Figure 8C:
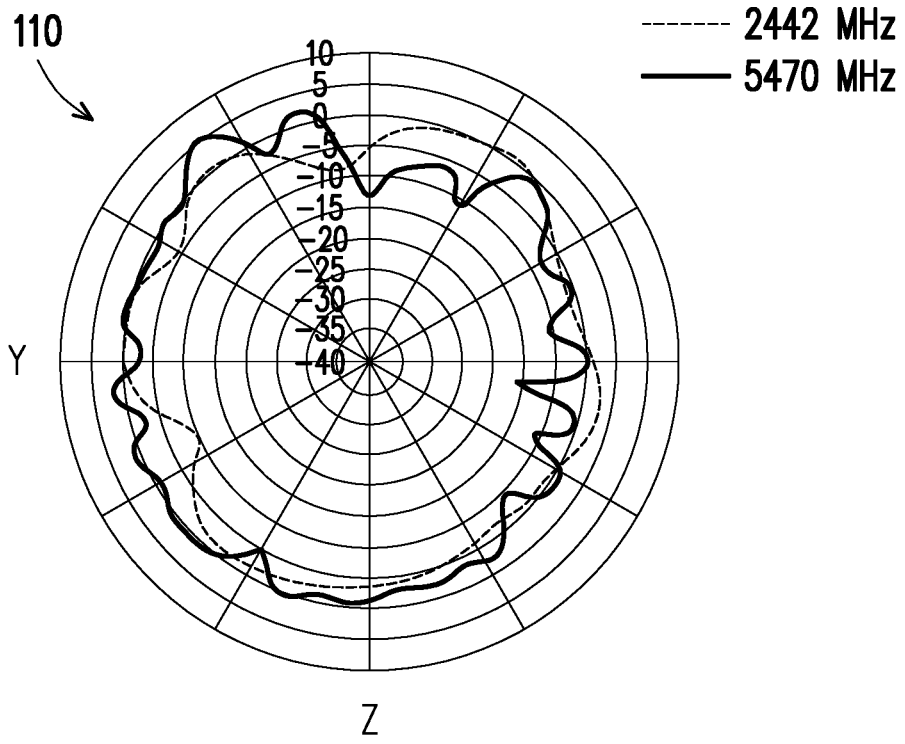
Figure 9A:
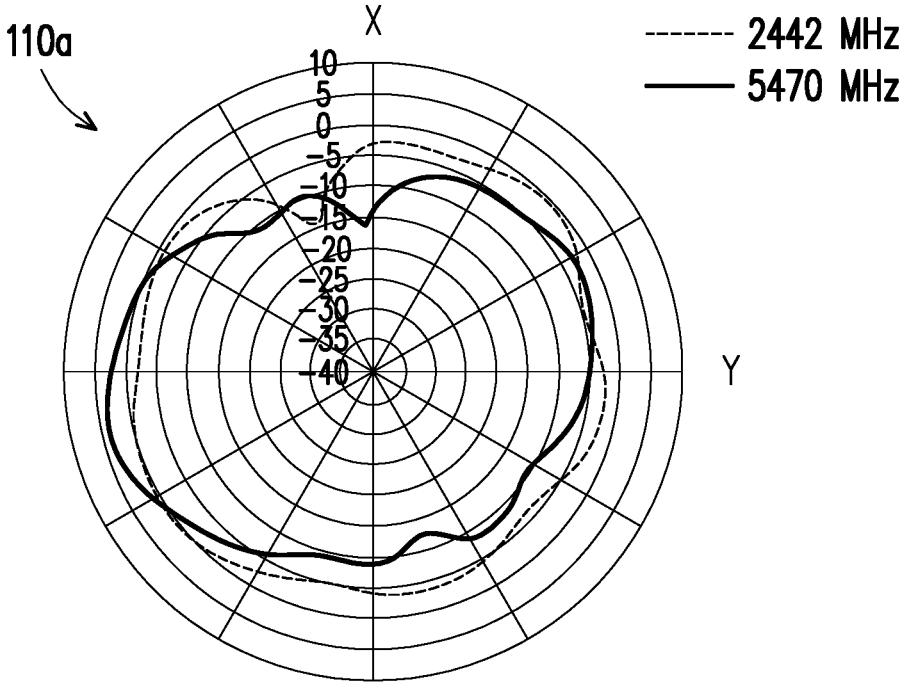
FIG. 9A, FIG. 9B, and FIG. 9C are schematic diagrams showing radiation patterns of the other dipole antenna of the multi-input multi-output antenna structure in FIG. 2 in the X-Y plane, the X-Z plane, and the Y-Z plane respectively.
Figure 9B:
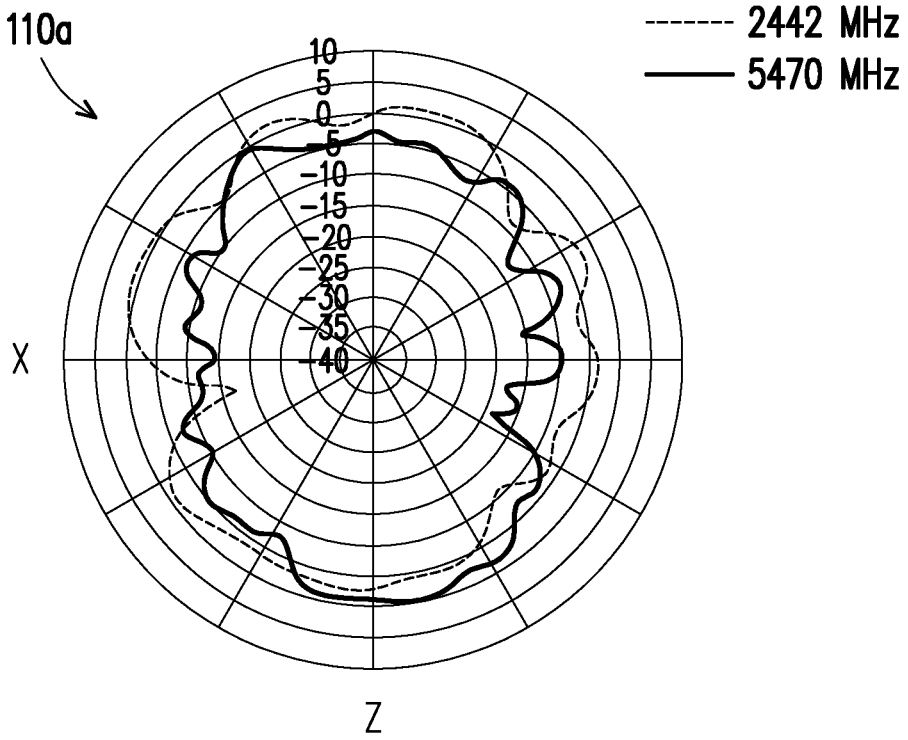
Figure 9C:
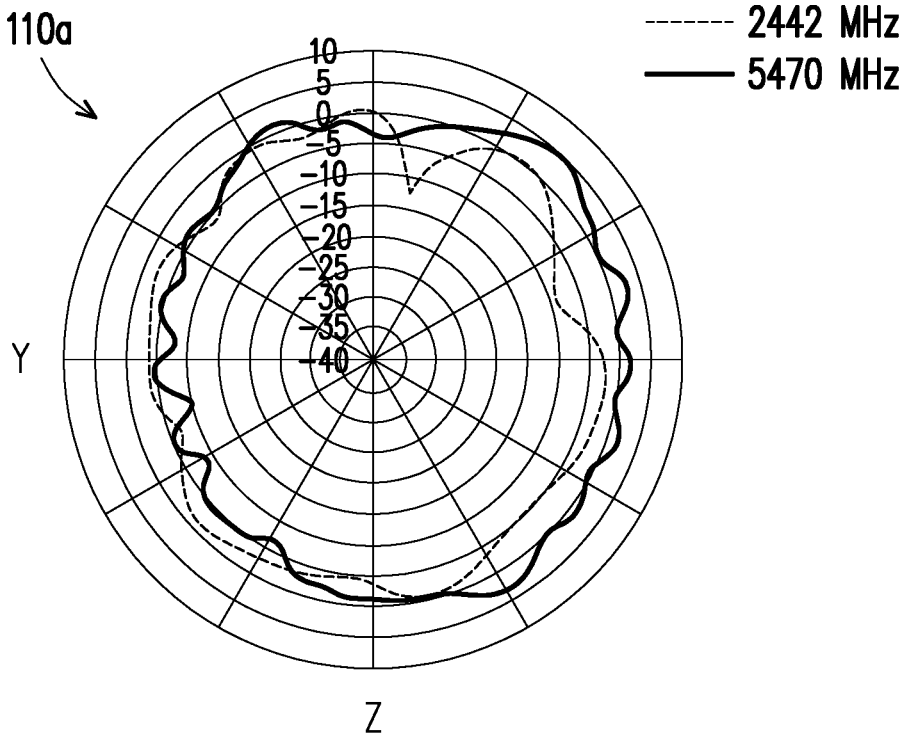

FIG. 8A, FIG. 8B, and FIG. 8C are schematic diagrams showing radiation patterns of one dipole antenna (the dipole antenna 110) in the multi-input multi-output antenna structure in FIG. 2 in an X-Y plane, an X-Z plane, and a Y-Z plane respectively. The dotted lines represent the first frequency band, and the solid line represents the second frequency band. FIG. 9A, FIG. 9B, and FIG. 9C are schematic diagrams showing radiation patterns of the other dipole antenna (dipole antenna 110*a*) in the multi-input multi-output antenna structure 100 in FIG. 2 in the X-Y plane, the X-Z plane, and the Y-Z plane respectively. The dotted lines represent the first frequency band, and the solid line represents the second frequency band. Referring to FIG. 8A to FIG. 9C, the radiation patterns of the two dipole antennas 110 and 110*a* at the first frequency band and the second frequency band do not have Null points on XY, XZ, and YZ planes, so that the two dipole antennas 110 and 110*a* have excellent omnidirectional performance.

Figure 10:
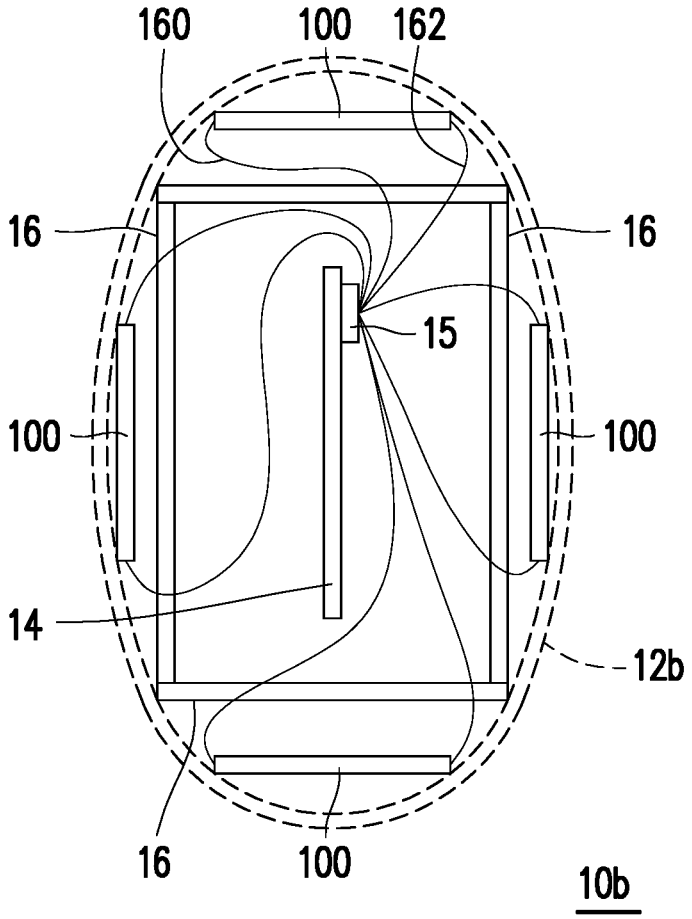
FIG. 10 is a schematic diagram of an electronic device according to another embodiment of the application.

FIG. 10 is a schematic diagram of an electronic device according to another embodiment of the application. Referring to FIG. 10, the main differences between the electronic device 10*b* in FIG. 10 and the electronic device 10 in FIG. 1 are as follows: In FIG. 10, the shell 12*b* of the electronic device 10*b* is an ellipsoid, the electronic device 10*b* is provided with a plurality of (for example, four) multi-input multi-output antenna structures 100, and each multi-input multi-output antenna structure 100 is provided with two dipole antennas 110 and 110*a* and two second grounded radiators 140. As shown in FIG. 10, the four multi-input multi-output antenna structures 100 are respectively configured at symmetrical positions of the shell 12*b*, for example, upper, lower, left, and right positions. Each multi-input multi-output antenna structure 100 is separated from the circuit board 14 through the shielding component 16 and is connected to the wireless module card 15 of the circuit board 14 through the coaxial transmission lines 160 and 162. In this embodiment, the electronic device 10*b* may be provided with a plurality of multi-input multi-output antenna structures 100, and the multi-input multi-output antenna structures 100 can respectively resonate the first frequency band and the second frequency band with good signals in a limited space to achieve dual-frequency property.

In conclusion, in the multi-input multi-output antenna structure of the application, the two second grounded radiators are configured between the two dipole antennas and are separated from the two first grounded radiators of the two dipole antennas, and furthermore, the design of the bent gap between the two second grounded radiators enables the two dipole antennas to have good isolation. In this way, the two dipole antennas can be quite close but do not interfere with each other, so that the multi-input multi-output antenna structure has a smaller size. Therefore, the multi-input multi-output antenna structure can respectively resonate the first frequency band and the second frequency band with good signals in a limited space to achieve dual-frequency property.

Although the application has been described with reference to the above embodiments, the embodiments are not intended to limit the application. Any person skilled in the art may make variations and improvements without departing from the spirit and scope of the application. Therefore, the protection scope of the application should be subject to the appended claims.

What is claimed is:

1. An electronic device, comprising:
- a shell;
- a circuit board, configured in the shell;
- at least one multi-input multi-output antenna structure, configured in the shell, being in signal connection to the circuit board and comprising:
  - two dipole antennas, wherein each dipole antenna is used for resonating a first frequency band and a second frequency band, and each dipole antenna comprises:
    - a feed-in radiator having a feed-in end; and
    - a first grounded radiator, disposed beside the feed-in radiator, being separated from the feed-in radiator and having a first grounded end; and
  - two second grounded radiators, positioned between the two dipole antennas, wherein the two second grounded radiators are separated from the two first grounded radiators, respectively corresponding to the two first grounded radiators and both located between the two first grounded radiators, and a bent gap is formed between the two second grounded radiators; and
- a shielding component, configured in the shell and positioned between the multi-input multi-output antenna structure and the circuit board.

2. The electronic device according to claim 1, wherein the distance between the at least one multi-input multi-output antenna structure and the shielding component ranges from 15 mm to 70 mm.

3. The electronic device according to claim 1, wherein the shell is a cylinder, an ellipsoid, a cuboid, a trapezoidal column, or a rugby ball body.

4. An electronic device, comprising:
- a shell;
- a circuit board, configured in the shell;
- at least one multi-input multi-output antenna structure, configured in the shell, being in signal connection to the circuit board and comprising:

two dipole antennas, wherein each dipole antenna is used for resonating a first frequency band and a second frequency band, and each dipole antenna comprises:

a feed-in radiator having a feed-in end; and a first grounded radiator, disposed beside the feed-in radiator and having a first grounded end; and two second grounded radiators, positioned between the two dipole antennas, wherein the two second grounded radiators are separated from the two first grounded radiators and are respectively corresponding to the two first grounded radiators, and a bent gap is formed between the two second grounded radiators, wherein the multi-input multi-output antenna structure has a virtual center, and one dipole antenna and the corresponding second grounded radiator can be rotated by 180 degrees around the virtual center as an axis to be overlapped with the other dipole antenna and the other second grounded radiator; and a shielding component, configured in the shell and positioned between the multi-input multi-output antenna structure and the circuit board.

* * * * *